US006585493B2

(12) United States Patent
Sutton

(10) Patent No.: US 6,585,493 B2
(45) Date of Patent: Jul. 1, 2003

(54) HYGIENIC SELF-PRIMING CENTRIFUGAL PUMP

(75) Inventor: Michael Sutton, Horsens (DK)

(73) Assignee: APV Fluid Handling Horsens A/S, Horsens (DK)

( * ) Notice: Subject to any disclaimer, the term of this patent is extended or adjusted under 35 U.S.C. 154(b) by 0 days.

(21) Appl. No.: 09/956,347

(22) Filed: Sep. 20, 2001

(65) Prior Publication Data

US 2002/0034446 A1 Mar. 21, 2002

(30) Foreign Application Priority Data

Sep. 20, 2000 (DK) ..... 2000 00278 U

(51) Int. Cl.[7] ..... F04C 19/00

(52) U.S. Cl. ..... 417/69; 417/199.2; 417/307; 417/300; 417/69

(58) Field of Search ..... 417/199.2, 307, 417/300, 69

(56) References Cited

U.S. PATENT DOCUMENTS 3,082,694 A * 3/1963 Brkich ..... 417/56.1
3,381,621 A * 5/1968 Luhmann et al. ..... 417/56.1
4,523,893 A * 6/1985 Johst et al. ..... 417/68
5,599,171 A * 2/1997 Horwitz ..... 415/143
6,152,689 A * 11/2000 Yokota et al. ..... 415/143

* cited by examiner

*Primary Examiner*—Charles G. Freay
*Assistant Examiner*—Emmanuel Sayoc
(74) *Attorney, Agent, or Firm*—McDermott, Will & Emery

(57) ABSTRACT

A hygienic, self-priming centrifugal pump (1) with a pump housing (4) provided with an inlet opening (2) and a pressure connecting piece (3), where an impeller wheel (7) can rotate inside said pump housing. The inlet opening (2) is connected with a liquid ring pump section (9) comprising an auxiliary housing (10) and a pump screw (11). The pump screw (11) is mounted on and in extension of the hub (7*a*) of the impeller wheel. A recycling pipe (15) for pump liquid connects the pressure connecting piece (3) of the centrifugal pump and the auxiliary housing (10) of the liquid ring pump section (9), optionally the inlet nozzle (16) or the inlet pipe (18) of the latter. All the surfaces in the pump housing (4) and the auxiliary housing (10) in direct contact with liquid should be smooth and rounded and without holes, crevices, beads or burrs. As a result, the efficiency of the centrifugal pump has been improved, and furthermore the centrifugal pump is more suited for both CIP-cleaning and ordinary manual cleaning than hitherto known pumps.

11 Claims, 4 Drawing Sheets

HYGIENIC SELF-PRIMING CENTRIFUGAL PUMP

Figure 1:
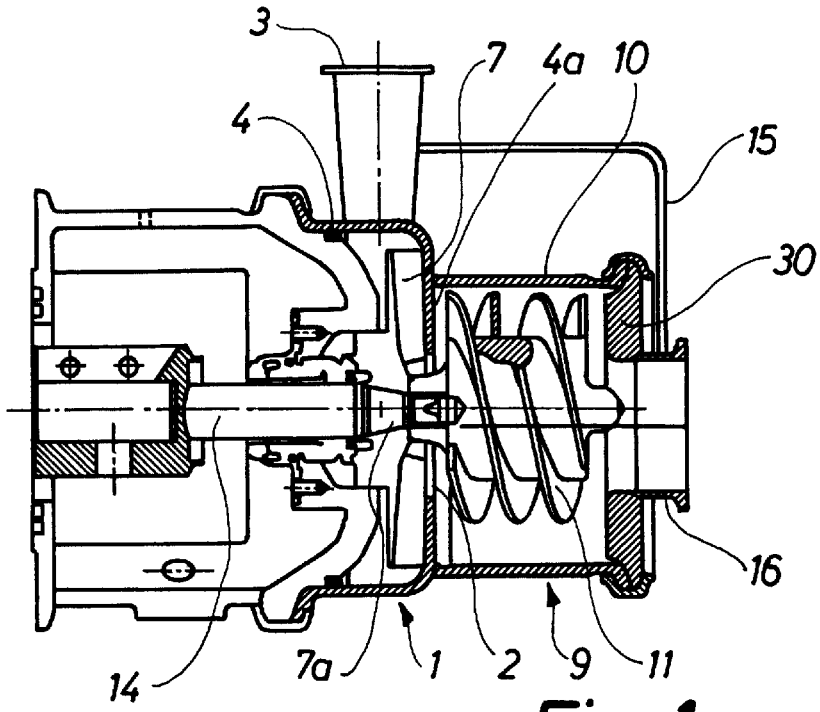

The invention relates to a hygienic self-priming centrifugal pump with a pump housing provided with an inlet opening and a pressure connecting piece, where an impeller wheel can rotate inside said pump housing, and where said inlet opening is connected to an axial liquid ring pump section comprising an auxiliary housing and a pump screw, said pump screw being mounted on and in extension of the hub of the impeller wheel.

It has been known for a long time that centrifugal pumps are encumbered with the significant draw-back that they cannot tolerate water containing a high amount of air or gas when they are used for pumping water or other easy-flowing liquids. As soon as the amount of air pumped together with the water exceeds a predetermined percentage, typically 4 to 5%, the pump ceases to operate, which is also the case when the centrifugal pump is to be started. Then it is necessary to prime the pump, viz. to fill it with water before it is started.

The centrifugal pumps can be structured so as to overcome the above priming problems by being structured like a so-called self-priming pump. The two most conventional ways of obtaining a self-priming is 1) to separate the air from the water by said air leaving the impeller wheel and by the water being returned to a reservoir located in front of the pump; and 2) to include a vacuum pump in the centrifugal pump, such as either a positive displacement pump or a pump of the liquid ring type, where the vacuum pump is mounted on the shaft about which the impeller wheel of the centrifugal pump rotates.

When the pump is to be hygienic, i.e. when it is to be used for pumping articles of food and pharmaceutical products, said pump must be able to tolerate the cleaning and sterilizing liquids used in connection with the production of such articles, and the pump must be easy to clean. Therefore, the parts of many of these pumps must be easy to disassemble so as to allow access to the interior of the pumps in order to carry out a manual cleaning. A frequent requirement presented to the pumps is that they must be particularly easy to clean, i.e. it must be possible to clean the pump merely by circulating rinsing and cleaning liquid through said pump. Therefore, very strict requirements are presented to the structure of the pump, especially to the interior of the pump and to the surfaces and channels thereof which are in contact with the liquid. These surfaces and channels must be smooth and without crevices. The known self-priming pumps are very difficult to clean in situ in accordance with the prescribed requirements, and therefore they cannot be considered CIP-easy pumps, viz. pumps which are easy to clean in place (CIP).

From a producer's point of view a further draw-back is found in the fact that the known self-priming centrifugal pumps are very different from the conventional centrifugal pumps because very few parts are identical in the two types of pumps. In addition, the efficiency of the known self-priming centrifugal pumps is not completely satisfactory.

The object of the invention is to provide a pump of the above type which presents a very simple structure, which in an easy manner allows both a CIP-cleaning and an ordinary manual cleaning, and which presents a higher efficiency than the known self-priming centrifugal pumps.

The centrifugal pump according to the invention is characterised in that a recycling pipe for liquid is arranged so as to connect the pressure connecting piece of the centrifugal pump on one side with the auxiliary housing of the liquid ring pump section and optionally the inlet nozzle or inlet pipe of the latter on the other side, and that all the inner surfaces in the pump housing and the auxiliary housing in direct contact with the liquid are smooth and rounded and without holes, crevices, beads or burrs.

These features render it possible for the centrifugal pump to maintain a higher efficiency than the known self-priming pumps by means of the liquid ring pump section. The recycling pipe has the effect that the risk has been avoided of the liquid ring disappearing partially or completely from the auxiliary housing while only involving an insignificant drop in the efficiency. In addition it is obtained that the centrifugal pump is suited for both CIP-cleaning and manual cleaning, and furthermore it presents a very simple structure.

According to the invention the connection of the recycling pipe to the auxiliary housing of the liquid ring pump section or to the inlet nozzle thereof may be radially arranged relative to one of these parts. As a result, the manufacture of the self-priming centrifugal pump is particularly easy.

Moreover, the connection of the recycling pipe to the auxiliary housing of the liquid ring pump section or to the inlet nozzle thereof may according to the invention be such that said connection extends tangential to one of these parts, whereby the recycled liquid is absorbed in the liquid ring instead of flowing straight through the auxiliary housing.

According to the invention the recycling pipe may optionally by means of a nozzle built therein be dimensioned such that the amount of liquid being recycled per time unit is maximum 10% of the amount of liquid passing the impeller wheel per time unit, said nozzle for instance being built into the connection between the recycling pipe and the pressure connecting piece. As a result, a particularly high efficiency is obtained for the centrifugal pump.

According to the invention an adjustable throttle valve may be built in the recycling pipe with the result that a particularly good possibility of controlling the recycled quantity of liquid is obtained.

In addition, the adjustable throttle valve may according to the invention be adapted to be automatically controlled by means of a pressure sensor arranged at the pressure connecting piece of the pump housing and/or in the auxiliary housing or in the inlet nozzle thereof, or by means of a flowmeter or a device measuring the motor output, or by means of a pressure sensor or a flowmeter arranged in the piping to and from the centrifugal pump, or by means of a differential pressure sensor measuring the pressure drop across the pump. This has proved particularly advantageous.

Moreover, the recycling pipe may according to the invention comprise short pipe stubs provided with a mounting flange, as well as an intermediary length of pipe arranged between said pipe stubs and provided with a mounting flange at both ends with the result that a particularly easy mounting of the recycling pipe is obtained.

According to the invention the recycling pipe may be adapted to be easily demountable from openings in the walls of the pump, such as holes in sleeves or sleeve stubs in said walls, and be replaced by plugs provided with a sealing rubber O-ring placed in such a manner that CIP-liquid can enter easily. As a result, when a user gradually finds out that the recycling pipe is not necessary, then he can easily remove said pipe.

When the diffuser of the centrifugal pump extends substantially vertically upwards and said pressure connecting piece is placed at the top, then the inlet pipe mounted on the inlet nozzle of the liquid ring pump section may over a portion of its length according to the invention extend substantially parallel to said diffuser and at a relatively short distance therefrom, whereby a corresponding recycling pipe may extend between the diffuser and said portion of the inlet pipe extending substantially in parallel. This has proved particularly advantageous.

Furthermore according to the invention, the outer side of the wall in the housing of the centrifugal pump and the inner side of the front wall of the auxiliary housing may be provided with a trough-shaped recess with rounded transitions extending along at least 180° about the pump screw, said outer side of the wall in the housing including the above suction nozzle. As a result, an increase of the efficiency of the pump is obtained because vortices can easily slide off at these recesses.

According to the invention, the auxiliary housing of the liquid ring pump section may be connected to the housing of the centrifugal pump by way of welding, whereby it is possible to obtain a particularly smooth transition between the two housings and consequently it is easy to carry out a cleaning.

Finally, the connection of the recycling pipe to the auxiliary housing may according to the invention be provided by said recycling pipe extending through the front wall of said auxiliary housing, preferably obliquely through said front wall of said auxiliary housing in such a manner that at the front wall the pipe is directed towards the pump screw. This has proved particularly advantageous.

Figure 2:
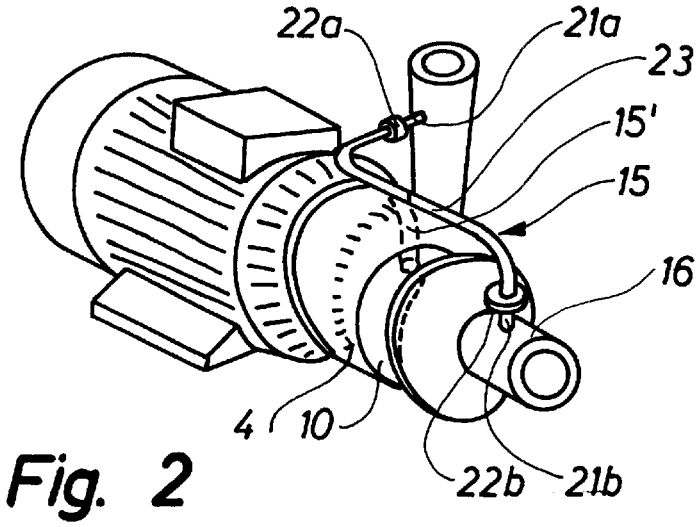
Figure 3:
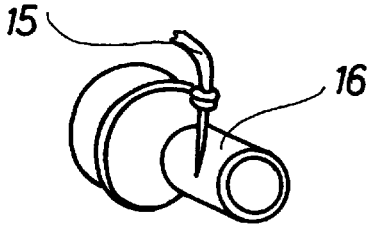
Figure 4:
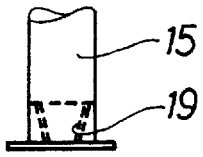
Figure 6:
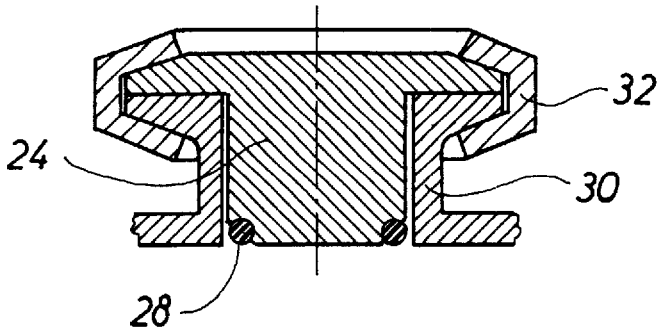
Figure 5:
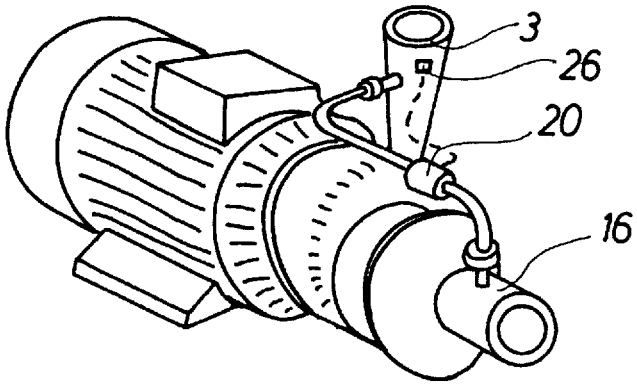
Figure 7:
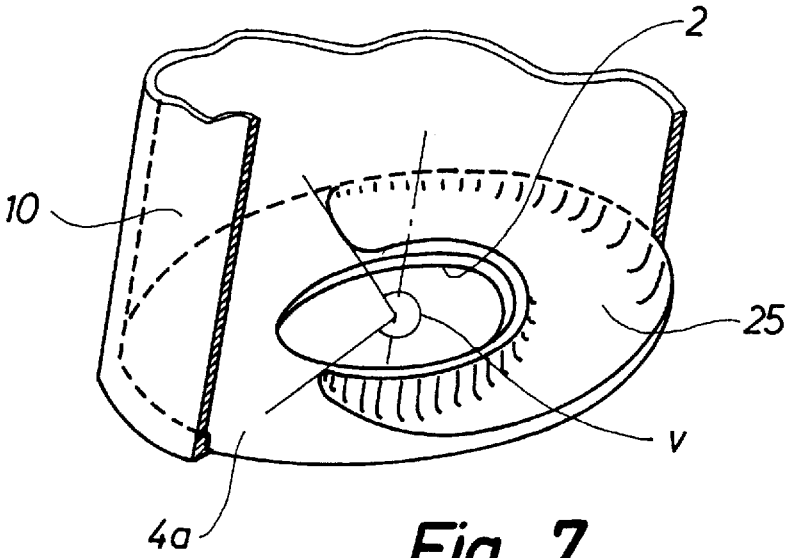
Figure 8:
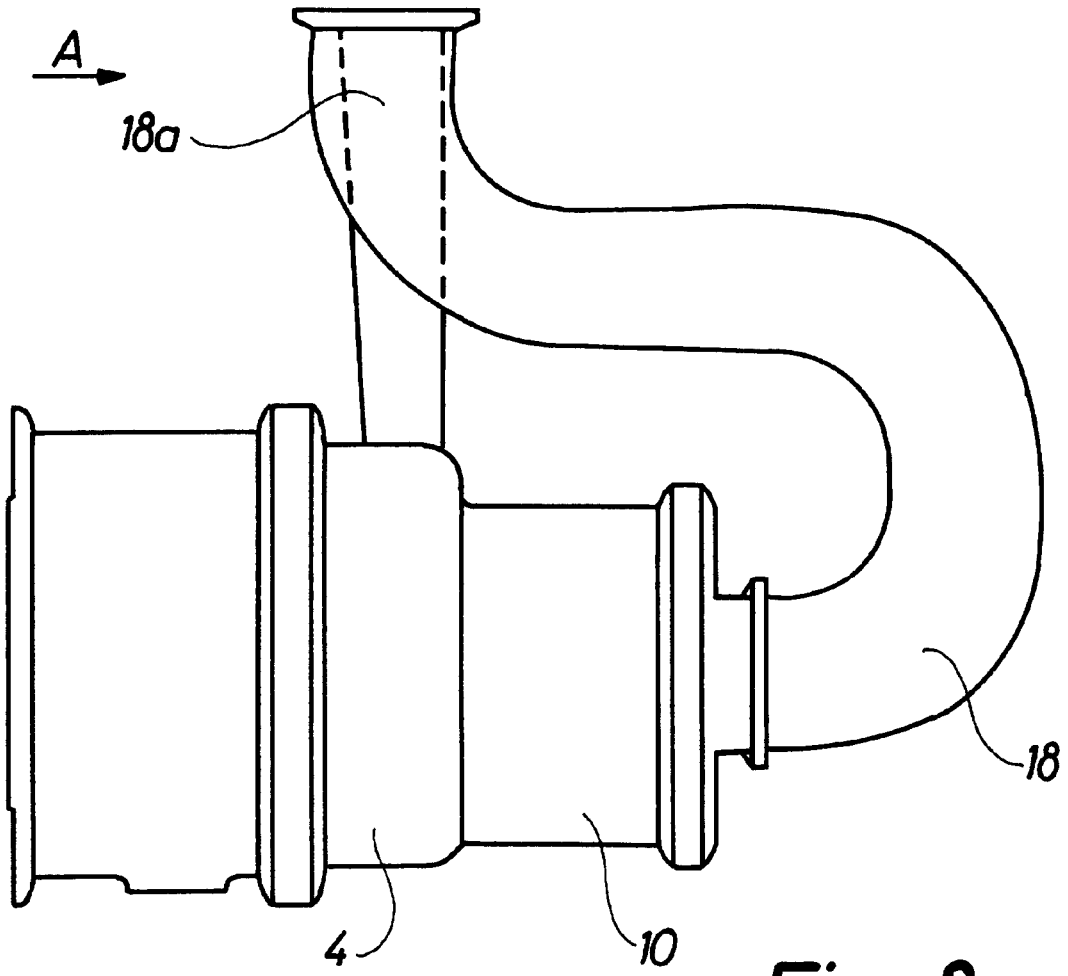
Figure 9:
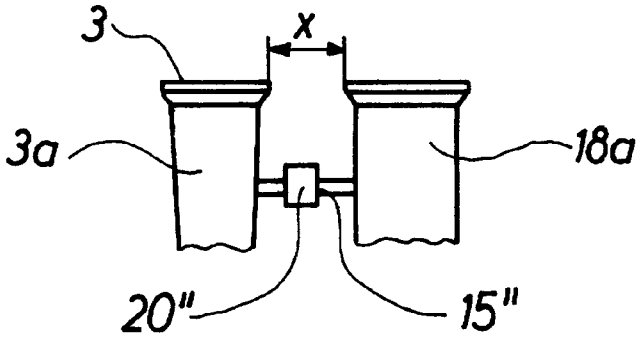
Figure 10:
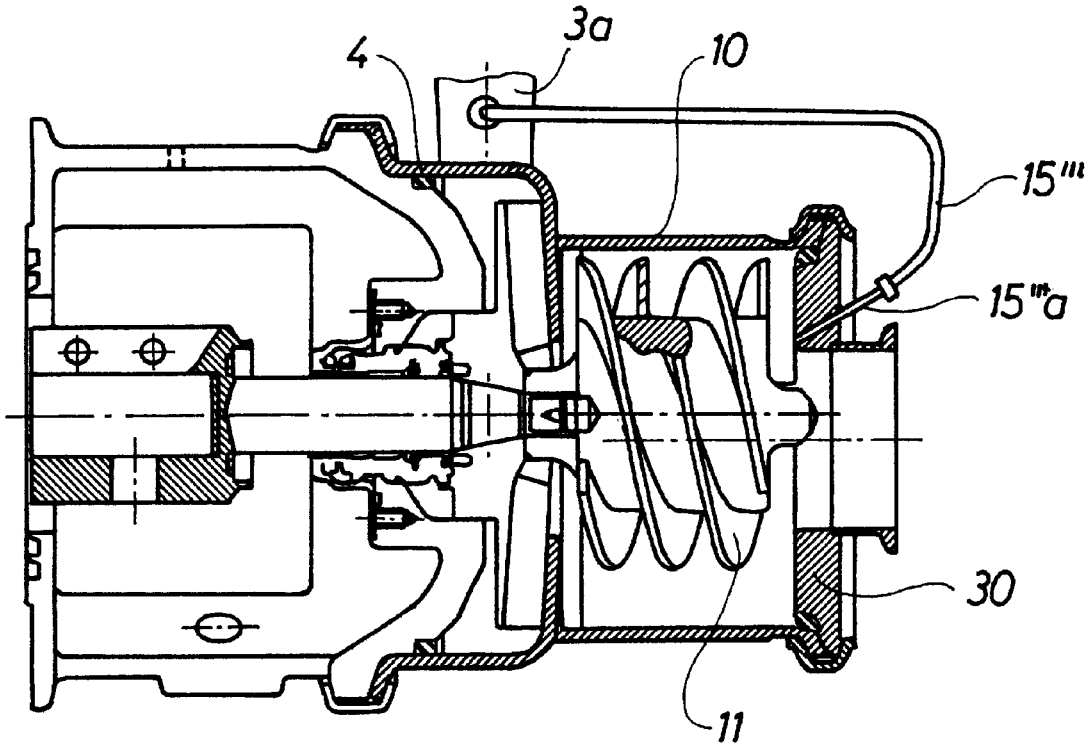

The invention is explained in detail below with reference to the drawings, in which FIG. 1 is a vertical sectional view through an embodiment of the centrifugal pump according to the invention, the recycling pipe, however, not being sectioned, FIG. 2 is a perspective view of an embodiment of the centrifugal pump, the recycling pipe being radially mounted on the nozzle of the auxiliary housing in the liquid ring pump section, FIG. 3 is a perspective view of an inlet nozzle on the auxiliary housing of the liquid ring pump section, where the connection of the recycling pipe with the nozzle is tangential, FIG. 4 is a side view of a portion of a recycling pipe, where a nozzle is inserted adjacent a mounting flange, FIG. 5 is a perspective view of an embodiment of the centrifugal pump, an adjustable, preferably automatically acting throttle valve being inserted in the recycling pipe, FIG. 6 is a longitudinal sectional view through a flanged stub on a wall, where the recycling pipe has been removed and where a plug with a rubber sealing ring has been inserted in said flanged stub, FIG. 7 is a perspective view of a portion of the outer side of the wall in the housing of the centrifugal pump, in which the suction opening of said centrifugal pump is provided, FIG. 8 illustrates yet another embodiment of the centrifugal pump, where a portion of the inlet pipe connected to the inlet nozzle of the liquid ring pump section is parallel to the diffuser of the centrifugal pump, FIG. 9 illustrates the embodiment shown in FIG. 8 in the direction indicated by the arrow A of FIG. 8, only the uppermost portion of said embodiment being shown, and FIG. 10 is a vertical, longitudinal, sectional view of an embodiment of the centrifugal pump, where the recycling pipe extends through the front wall of and into the auxiliary housing.

The hygienic self-priming centrifugal pump shown in FIG. 1 is designated the general reference numeral 1. In the pump housing 4, the centrifugal pump comprises an inlet opening 2 and a pressure connecting piece 3. An impeller wheel 7 can rotate inside the pump housing. The inlet opening 2 is connected to a liquid ring pump section 9 comprising an auxiliary housing 10 and a pump screw 11. The centrifugal pump comprises a shaft 14, and at one end of said shaft the hub 7*a* of the impeller wheel 7 is mounted. The pump screw 11 is mounted on and in extension of the hub 7. A recycling pipe 15 for pump liquid is arranged between the pressure connecting piece 3 of the centrifugal pump and the auxiliary housing 10 of the liquid ring pump section 9 in such a manner that a predetermined, although low amount of pressure fluid in the pump can be returned to the liquid ring pump section from the pressure side of the centrifugal pump and thereby ensure the self-priming of the pump. All the inner surfaces of the pump housing 4 and the auxiliary housing 10 should be smooth and rounded and without holes, crevices, beads and burrs so as to ensure that the pressure drop inside the pump is very small and the pump operates in a satisfactorily hygienic manner.

As illustrated in FIG. 2, the connection of the recycling pipe 15 to the inlet nozzle 16 on the auxiliary housing 10 of the liquid ring pump section 11 can be radial relative to said inlet nozzle 16. However, it is also possible to connect the recycling pipe in a radial manner relative to the auxiliary housing 10, cf. the dotted lines 15.

FIG. 3 shows how the recycling pipe 15 can be connected tangentially to the inlet nozzle 16. However, nothing prevents the pipe 16 from being tangentially connected to the auxiliary housing 10.

The recycling pipe 15 can be connected to an inlet pipe 18 for the pump, cf. at 15" in FIG. 9, instead of being connected to the inlet nozzle 16 or the auxiliary housing 10, which will be explained in greater detail below.

The recycling pipe 15 can be dimensioned for instance by means of of a nozzle 19 built therein in such a manner that the amount of liquid being recycled per time unit is maximum 10% of the amount of liquid passing the impeller wheel 7 per time unit. The nozzle 19 can, if desired, be built into the flanged stub of the diffuser 3*a,* i.e. in the connection between the recycling pipe and the diffuser, viz. the outlet.

FIG. 5 shows how an adjustable throttle valve 20 can be built in the recycling pipe 15. This valve can be automatically controlled by means of a pressure sensor 26 at the pressure connecting piece 3 of the pump housing and/or by means of a pressure sensor provided in the auxiliary housing 10 or in the inlet nozzle 16 thereof. The automatic control can also be carried out by means of a flowmeter not shown, but built in the pump, or by means of a device measuring the motor output and not shown either.

In addition, the control can be carried out by means of a pressure sensor not shown or a flowmeter not shown. The latter flowmeter is arranged in the piping to and from the centrifugal pump. Yet another possibility of an automatic control can be obtained by means of a differential pressure sensor not shown measuring the drop of pressure across the pump.

As illustrated in FIG. 2, the recycling pipe 15 can comprise short pipe stubs 21*a,* 21*b* provided with a mounting flange 22*a,* 22*b* as well as an intermediary length of pipe 23 provided with a mounting flange at both ends. These mounting flanges ensure a very reliable joining of the recycling pipe.

As illustrated in FIG. 6, the recycling pipe can be adapted to be easily dismountable from holes in the walls, such as holes in sleeves or flanged stubs 30 on the walls, and to be replaced by plugs 24 with sealing rubber O-rings 28 which can be cleaned. The plug 24 is retained in position by means of a locking ring 32.

FIG. 7 shows how the outer side of the wall 4*a* in the housing 4 of the centrifugal pump can be provided with a trough-shaped recess 25 with rounded transitions and extending along at least 180° about the axis of the pump screw 11, said wall 4*a* in the housing 4 of the centrifugal pump presenting the inlet opening 2 as well as the inner side of the front wall in the auxiliary housing not shown. The angle v shown is at least 180°.

As illustrated in FIG. 8, inlet pipe 18 mounted on the inlet nozzle 16 of the liquid ring pump section 9 can be particularly long. Over a portion 18*a* of its length, this inlet pipe 18 can extend substantially parallel to the diffuser 3*a* of the centrifugal pump 1 and at a relatively short distance x from said diffuser, the pressure connecting piece 3 of said centrifugal pump being placed at the end of said diffuser. A correspondingly short recycling pipe 15" extends between the diffuser 3*a* and said inlet pipe portion 18*b*.

As illustrated in FIG. 1, the auxiliary housing 10 of the liquid ring pump section 9 can be connected to the housing 4 of the centrifugal pump by way of welding.

FIG. 10 shows how the recycling pipe 15" can extend into the auxiliary housing 10 of the liquid ring pump section 9 by passing through the front wall 30 of said auxiliary housing 10. As shown, here the recycling pipe is directed towards the pump screw 11. Furthermore as shown, the recycling pipe length 15"*a* can be arranged on a central, longitudinal plane inside the auxiliary housing, the axis of the pipe length 15"*a* intersecting the axis of rotation of the pump screw.

The invention may be modified in many ways without thereby deviating from the scope of the invention, as it appears from the attached claims.

What is claimed is:

1. A hygienic self-priming centrifugal pump comprising:

a pump housing provided with an inlet opening and a pressure connecting piece; and an impeller wheel having a hub, said impeller wheel being configured to rotate inside said pump housing, said inlet opening being connected to an axial liquid ring pump section including an auxiliary housing and a pump screw, said pump screw being mounted on and in extension of the hub of the impeller wheel, wherein a recycling pipe for liquid is arranged as a connection between the pressure connecting piece of the centrifugal pump and one of:

the auxiliary housing of the liquid ring pump section, an inlet nozzle of the auxiliary housing, and an inlet pipe for the pump, all inner surfaces in the pump housing and the auxiliary housing in direct contact with the liquid are smooth and rounded and without holes, crevices, beads or burrs, and the connection of the recycling pipe to the auxiliary housing of the liquid ring pump section, to the inlet nozzle thereof, or to the inlet pipe for the pump is arrange tangentially relative to the respective part.

2. The centrifugal pump as claimed in claim 1, wherein the recycling pipe is dimensioned using a nozzle built in the connection between said recycling pipe and the pressure connecting piece, the recycling pipe being dimensioned so that an amount of liquid being recycled per time unit is maximum 10% of the amount of liquid passing the impeller wheel per time unit.

3. The centrifugal pump as claimed in claim 2, wherein an adjustable throttle valve is built in the recycling pipe.

4. The centrifugal pump as claimed in claim 3, wherein the adjustable throttle valve is adapted to be automatically controlled by means of a pressure sensor placed at one of:

the pressure connecting piece of the pump housing, in the auxiliary housing, and in the inlet nozzle of the pump housing.

5. The centrifugal pump as claimed in claim 4, wherein the recycling pipe comprises short pipe stubs, each provided with a mounting flange, as well as an intermediary pipe length arranged between said short pipe stubs and provided with a mounting flange at both ends.

6. The centrifugal pump as claimed in claim 5, wherein the recycling pipe is adapted to be easily dismountable from openings in the walls of the pump, the openings to be replaced by plugs provided with a sealing rubber O-ring placed in such a manner that CIP-liquid can enter easily, the openings in the wall of the pump include holes in sleeves and sleeve stubs in the walls.

7. The centrifugal pump as claimed in claim 1, further comprising:

a diffuser of the centrifugal pump extending substantially vertically upwards, said pressure connecting piece being placed at the top of the diffuser, wherein the inlet pipe is mounted on the inlet nozzle of the liquid ring pump section, a portion of the length of the inlet pipe extends substantially parallel to the diffuser and at a relatively short distance therefrom, and a corresponding recycling pipe extends between the diffuser and said inlet pipe portion extending substantially in parallel to the diffuser.

8. The centrifugal pump as claimed in claim 7, wherein an outer side of a wall in the housing of the centrifugal pump and an inner side of a front wall of the auxiliary housing are provided with a trough-shaped recess with rounded transitions and extending along at least 180° about the pump screw, said wall in the housing of the centrifugal pump includes the inlet opening.

9. The centrifugal pump as claimed in claim 8, wherein the auxiliary housing of the liquid ring pump section is welded to the housing of the centrifugal pump.

10. The centrifugal pump as claimed in claim 9, wherein the connection between the recycling pipe and the auxiliary housing is provided by the recycling pipe extending obliquely through the front wall of the auxiliary housing such that at the front wall the recycling pipe is directed towards the pump screw.

11. The centrifugal pump as claimed in claim 3, wherein the adjustable throttle valve is adapted to be automatically controlled by means selected from the group consisting of a flowmeter in the pump, a device measuring the motor output, a pressure sensor arranged in the piping to and from the centrifugal pump, a flowmeter arranged in the piping to and from the centrifugal pump, and a differential pressure sensor measuring the drop of pressure across the pump.

* * * * *